US010968400B2

(12) United States Patent
Koseoglu

(10) Patent No.: US 10,968,400 B2
(45) Date of Patent: Apr. 6, 2021

(54) PROCESS TO REMOVE OLEFINS FROM LIGHT HYDROCARBON STREAM BY MERCAPTANIZATION FOLLOWED BY MEROX REMOVAL OF MERCAPTANS FROM THE SEPARATED STREAM

(71) Applicant: Saudi Arabian Oil Company, Dhahran (SA)

(72) Inventor: Omer Refa Koseoglu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/527,711

(22) Filed: Jul. 31, 2019

(65) Prior Publication Data

US 2021/0032547 A1 Feb. 4, 2021

(51) Int. Cl.
*C10G 27/12* (2006.01)
*C10G 57/00* (2006.01)

(52) U.S. Cl.
CPC ..... *C10G 27/12* (2013.01); *C10G 57/00* (2013.01); *C10G 2300/104* (2013.01); *C10G 2300/202* (2013.01); *C10G 2300/4018* (2013.01); *C10G 2400/22* (2013.01)

(58) Field of Classification Search
None
See application file for complete search history.

(56) References Cited

U.S. PATENT DOCUMENTS 2,430,269 A 11/1947 Bell
2,452,040 A 10/1948 Drennan
2,862,804 A * 12/1958 Petty ..... C10G 29/20 44/353
5,453,544 A * 9/1995 Giacobbe ..... C07C 319/04 568/72
2006/0151359 A1 7/2006 Ellis et al.
2011/0163008 A1* 7/2011 Zhang ..... C10G 19/04 208/204
2015/0114883 A1* 4/2015 Tertel ..... C10G 19/02 208/203
2016/0145502 A1* 5/2016 Koseoglu ..... B01D 53/50 423/574.1
2016/0257646 A1* 9/2016 Cazaux ..... B01J 21/04
2018/0171244 A1 6/2018 Harandi

OTHER PUBLICATIONS

International Search Report and Written Opinion dated Sep. 21, 2020 in corresponding International Application PT/US2020/042223.

* cited by examiner

*Primary Examiner* — Tam M Nguyen
(74) *Attorney, Agent, or Firm* — Abelman, Frayne & Schwab

(57) ABSTRACT

A light naphtha feedstock containing olefins is introduced with hydrogen sulfide into a mercaptanization zone for conversion of the olefins into a mercaptan stream that is substantially free of olefins, after which the mercaptans are sent with an alkali caustic solution into a mercaptan oxidation treatment unit (MEROX) to produce a spent caustic stream and sweet light naphtha product stream that is substantially free of olefins and of mercaptans. Disulfide oils are produced from the wet air oxidation of the spent caustic, and the disulfide oils can be further processed to provide high purity olefin building blocks.

7 Claims, 4 Drawing Sheets

PROCESS TO REMOVE OLEFINS FROM LIGHT HYDROCARBON STREAM BY MERCAPTANIZATION FOLLOWED BY MEROX REMOVAL OF MERCAPTANS FROM THE SEPARATED STREAM

BACKGROUND OF THE INVENTION

Field of the Invention

This disclosure is directed to processes for the production of value-added products from light naphtha streams that contain quantities of olefins by mercaptanization and MEROX processes.

Description of Related Art

Many hydrocarbon streams derived from crude oils and intermediate refinery streams contain olefins. Intermediate refinery streams can be derived from processes including, but not limited to, catalytic reforming, steam cracking, fluid catalytic cracking, delayed coking or flexi-coking, isomerization, visbreaking, transalkylation, cracking in the presence of water and other types of non-conventional hydrocarbon processing.

The removal of the olefins from these crude oil or intermediate refinery streams is desirable for various reasons such as meeting product specifications and/or purity standards. Olefins have a tendency to dimerize, polymerize and/or undergo side reactions with other compounds present in the feed to produce undesirable co-products. For example, in an aromatic recovery complex, high purity is required for the aromatics produced. However, if the olefins are not removed, there is a high probability that they will undergo alkylation reactions with aromatic compounds in the feed to produce undesirable co-products, such as condensed and/or uncondensed poly-aromatics.

Another reason for removing olefins from crude oil or intermediate refinery streams is to eliminate or reduce fouling caused by the presence of olefins. For example, olefins can cause fouling in high temperature equipment, such as a xylene column reboiler, or interfere with xylene separation. Olefins can be removed in a clay treatment process. In this scheme, a hydrocarbon stream is contacted with a clay that is composed primarily of amorphous and crystalline mixtures of silica and alumina, such as, activated bentoniteattapulgus clay, or fuller's earth. The acidic nature of the clay causes the olefins to react with the aromatics present via an alkylation reaction to produce heavy hydrocarbons that can subsequently be removed by fractional distillation.

In other processes, it is important to remove olefins from the feed to prevent competitive adsorption between aromatics and olefins in adsorption separation processes, for example, in a physical separation process using molecular sieves where olefins will occupy sieve capacity and thereby adversely affect separation efficiency.

MEROX Process

The mercaptan oxidation (MEROX) process that has long been employed for the removal of the generally foul smelling mercaptans found in many hydrocarbon streams was introduced to the refining industry over fifty years ago. Because of regulatory requirements for reduction of the sulfur content of fuels for environmental reasons, refineries have been, and continue to be faced with the problem of disposing of large volumes of sulfur-containing by-products.

It is commonly referred to as a 'sweetening process' because it removes the sour or foul smelling mercaptans present in crude petroleum.

Disulfide oil (DSO) compounds are produced as a by-product of the MEROX process in which the mercaptans are removed from any of a variety of petroleum streams including liquefied petroleum gas, naphtha, and other hydrocarbon fractions. The term "DSO" is used for convenience in this description and in the claims, and will be understood to include the mixture of disulfide oils produced as by-products of the MEROX process.

The designation "MEROX" originates from the function of the process itself, i.e., the conversion of mercaptans by oxidation. The MEROX process in all of its applications is based on the ability of an organometallic catalyst in a basic environment, such as a caustic, to accelerate the oxidation of mercaptans to disulfides at near ambient temperatures and pressures, The overall reaction can be expressed as follows:

$$RSH+\tfrac{1}{4}\,O_2 \rightarrow \tfrac{1}{2}\,RSSR+1/2H_2O, \quad (1)$$

where R is a hydrocarbon chain that may be straight, branched, or cyclic, and the chains can be saturated or unsaturated. In most petroleum fractions, there will be a mixture of mercaptans so that the R can have 1, 2, 3 and up to 10 or more carbon atoms in the chain. This variable chain length is indicated by R and R' in the reaction. The reaction is then written:

$$2R'SH+2RSH+O_2 \rightarrow 2R'SSR+2H_2O \quad (2)$$

This reaction occurs spontaneously, but at a very slow rate, whenever any sour mercaptan-bearing distillate is exposed to atmospheric oxygen. In addition, the catalyzed reaction (1) requires the presence of an alkali caustic solution, such as sodium hydroxide. The mercaptan oxidation proceeds at an economically practical rate at moderate refinery downstream temperatures.

The MEROX process can be conducted on both liquid streams and on combined gas and liquid streams. In the case of liquid streams, the mercaptans are converted directly to disulfides which remain in the product so that there is no reduction in total sulfur content of the effluent stream. Because the vapor pressures of disulfides are relatively low compared to those of mercaptans, their presence is much less objectionable from the standpoint of odor; however, they are not environmentally acceptable and their disposal can be difficult. The MEROX process typically utilizes a fixed bed reactor system for liquid streams and is normally employed with charge stocks having end points above 135°-150°C. Mercaptans are converted to disulfides in the fixed bed reactor system over a catalyst, for example, an activated charcoal impregnated with the MEROX reagent, and wetted with caustic solution. Air is injected into the hydrocarbon feedstream ahead of the reactor and in passing through the catalyst-impregnated bed, the mercaptans in the feed are oxidized to disulfides. The disulfides are substantially insoluble in the caustic and remain in the hydrocarbon phase. Post treatment is required to remove undesirable by-products resulting from known side reactions such as the neutralization of $H_2S$, the oxidation of phenolic compounds, entrained caustic, and others.

In the case of mixed gas and liquid streams, extraction is applied to both phases of the hydrocarbon streams. The degree of completeness of the mercaptan extraction depends upon the solubility of the mercaptans in the alkaline solution, which is a function of the molecular weight of the individual mercaptans, the extent of the branching of the mercaptan molecules, the concentration of the caustic soda and the temperature of the system. Thereafter, the resulting DSO compounds are separated and the caustic solution is regenerated by oxidation with air in the presence of the catalyst and reused.

Referring to the attached drawings, FIG. 1 is a simplified schematic of a generalized version of the conventional prior art MEROX process of liquid-liquid extraction for removing sulfur compounds in an embodiment in which a combined propane and butane hydrocarbon stream (1) containing mercaptans is treated and which includes the steps of:

introducing the hydrocarbon stream (1) into an extraction vessel (10) with a homogeneous cobalt-based catalyst in the presence of caustic (2);

passing the hydrocarbon stream in counter-current flow through the extraction section of the extraction vessel (10) where the extraction section includes one or more liquid-liquid contacting extraction decks or trays (not shown) for the catalyzed reaction with the circulating caustic solution to convert the mercaptans to water soluble alkali metal alkane thiolate compounds;

withdrawing a hydrocarbon product stream (3) that is free or substantially free of mercaptans from the extraction vessel (10);

recovering a combined spent caustic and alkali metal alkane thiolate stream (4) from the extraction vessel (10);

subjecting the spent caustic to catalyzed wet air oxidation in a reactor (20) into which is introduced catalyst (5) and air (6) to produce the regenerated spent caustic (8) and convert the alkali metal alkane thiolate compounds to disulfide oils; and recovering a by-product stream (7) of disulfide oil (DSO) compounds and a minor proportion of sulfides.

The effluents of the wet air oxidation step in the MEROX process preferably comprise a minor proportion of sulfides and a major proportion of disulfide oils. A variety of catalysts have been developed for the commercial practice of the process. As is known to those skilled in the art, the composition of this effluent stream depends on the effectiveness of the MEROX process, and sulfides are assumed to be carried-over material. The efficiency of the MEROX process is also a function of the amount of $H_2S$ present in the stream. It is a common refinery practice to install a pre-washing step for $H_2S$ removal.

The disulfide oil compounds produced in the MEROX process can contain various disulfides. For example, a MEROX unit designed for the recovery of propane and butane yields a disulfide oil mixture with the composition set forth in Table 1:

TABLE 1

| Disulfide Oil | W % | BP, ° C. | MW, g/g-mol | Sulfur, W % |
|---|---|---|---|---|
| Dimethyldisulfide | 15.7 | 110 | 94 | 68.1 |
| Diethyldisulfide | 33.4 | 152 | 122 | 52.5 |
| Methylethydisulfide | 49.3 | 121 | 108 | 59.3 |
| Total (Average) | 98.4 | (127.69) | (109) | (57.5) |

Table 1 indicates the composition of the disulfide oil that is derived from semi-quantitative GC-MS data. No standards were measured against the components; however, the data in Table 1 is accurate in representing relative quantities. Quantitative total sulfur content was determined by energy dispersive x-ray fluorescence spectroscopy which indicated 63 wt % of sulfur, and this value is used in later calculations. The GC-MS results provide evidence for trace quantities of tri-sulfide species; however, the majority of the disulfide oil stream comprises the three components identified in Table 1.

Olefin Mercaptanization

The mercaptanization reaction is well known in the refining art. The process is described, for example, in U.S. Pat. No. 2,502,596, entitled "Reaction of Hydrogen Sulfide with Olefins", which is incorporated herein by reference, and describes the reactions and representative operating conditions. A more recent patent application, US 2016/0257646, "Method for synthesizing a Mercaptan by Adding Hydrogen Sulfide to an Olefin", which is also incorporated herein by reference, describes a process for synthesizing a mercaptan from a terminal olefin using hydrogen sulfide and comprises the following consecutive steps: (1) catalyzed addition of an excess of hydrogen sulfide to a terminal olefin in the presence of an acid catalyst; (2) separation of the products into a light fraction that includes the excess hydrogen sulfide and the olefins, and a heavy fraction that includes at least one mercaptan and, optionally, one or more thioethers.

It has been found that when olefins are converted, there is a substantial increase in the boiling points of the corresponding mercaptans. Table 2 summarizes the boiling points of C5-C7 olefins and their corresponding thiols. When 1-pentene, 1-hexene and 1-heptene are converted to their corresponding thiols, their boiling, points increase by 96° C., 87° C. and 83° C. respectively. The substantial increase in boiling points greatly facilitates the separation of the thiols from the remaining hydrocarbons.

TABLE 2

| Carbon Number | Olefin, ° C. | Thiol, ° C. | ΔT, ° C. |
|---|---|---|---|
| 5 | 30 | 126 | 96 |
| 6 | 63 | 150 | 87 |
| 7 | 94 | 177 | 83 |

Light naphtha streams containing olefins are typically hydrotreated and no useful products can be derived from the olefin content. An improved process is needed to more efficiently and cost-effectively convert olefins from light naphtha streams into value-added products than is currently available in the art.

SUMMARY OF THE INVENTION

The above needs are met and other benefits are realized by the process of the present disclosure that advantageously converts olefins present in sulfur-containing light naphtha streams via a mercaptanization reaction to provide an olefin-free sulfur-containing mercaptan stream. The mercaptans are then sweetened in a MEROX process step to produce a substantially olefin-free light naphtha stream. Low value sulfur-containing light naphthas are thereby converted into value-added products.

In one embodiment of the present process, a light naphtha feedstock comprising olefins is treated by:

a. introducing the light naphtha feedstock and hydrogen sulfide into a mercaptanization zone containing a catalyst for reaction of the $H_2S$ with the olefins to produce a treated effluent stream that is substantially free of olefins;

b. passing the treated effluent stream and an alkali caustic solution to a mercaptan oxidation treatment unit to produce a spent caustic and alkali metal alkane thiolate mixture stream, and a sweet light naphtha stream that is substantially free of olefins and of mercaptans;

c. recovering the sweet light naphtha stream;

d. passing the spent caustic and alkali metal alkane thiolate mixture stream, catalyst, and air into a wet air oxidation zone to product a regenerated spent caustic stream and a disulfide oils product stream; and e. recovering the disulfide oils product stream.

In another embodiment of the present process, a light naphtha feedstock comprising olefins is treated by:

a. introducing the light naphtha feedstock, an internally-generated mercaptan stream and an alkali caustic solution into a mercaptan oxidation treatment unit to produce a spent caustic and alkali metal alkane thiolate mixture stream and sweet light naphtha stream that is substantially mercaptan free and comprises olefins;

b. passing the spent caustic and alkali metal alkane thiolate mixture stream, catalyst, and air into a wet air oxidation zone to produce a regenerated spent caustic stream and a disulfide oils product stream;

c. recovering the disulfide oils product stream;

d. passing the sweet light naphtha stream and hydrogen sulfide into a mercaptanization zone containing a catalyst and catalytically reacting hydrogen sulfide with the olefins to produce a treated effluent stream that is substantially free of olefins;

e. passing the treated effluent stream to a fractionation zone and recovering a light naphtha stream and the mercaptan stream.

Olefins present in the light naphtha stream react with hydrogen sulfide in the presence of a catalyst to produce the corresponding mercaptans. The mercaptans are then sweetened in a MEROX process to produce a substantially olefin-free light naphtha stream. The substantially olefin-free light naphtha stream can be further processed in downstream processes such as steam cracking to produce value-added products such as ethylene.

Disulfide oils produced in accordance with the present disclosure can be used as sulfiding reagents and/or additives. Alternatively, the disulfide oils can be passed to downstream processes such as fluid catalytic cracking for production of such value added products as the high purity light olefins ethylene, propylene and the butylenes.

As used herein, the term "substantially olefin-free stream" means a stream with a bromine number of less than 1 g/100 g hydrocarbon oil. The bromine number can be determined by known methods, including ASTM D1159-01. When the bromine number is greater than 1 g/100 g of oil, the olefin content in the feedstream will polymerize and gum formation or "gumming" will occur under standard conditions.

BRIEF DESCRIPTION OF THE DRAWINGS

The process of the present disclosure will be described in more detail below and with reference to the attached drawings in which the same number is used for the same or similar elements, and where.

DETAILED DESCRIPTION OF PREFERRED EMBODIMENTS

Figure 1:
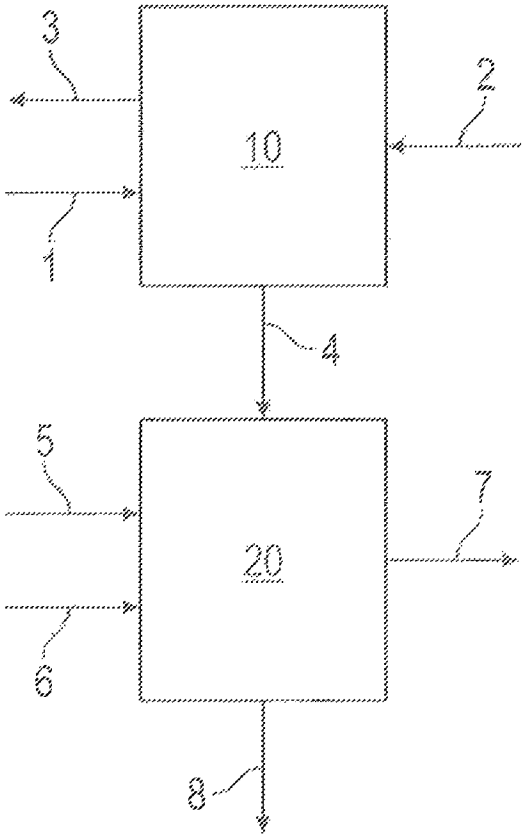
FIG. 1 (Prior Art)
FIG. 1 is a simplified schematic diagram of a generalized version of the MEROX process of the prior art for the liquid-liquid extraction of a combined propane and butane stream.
Figure 2:
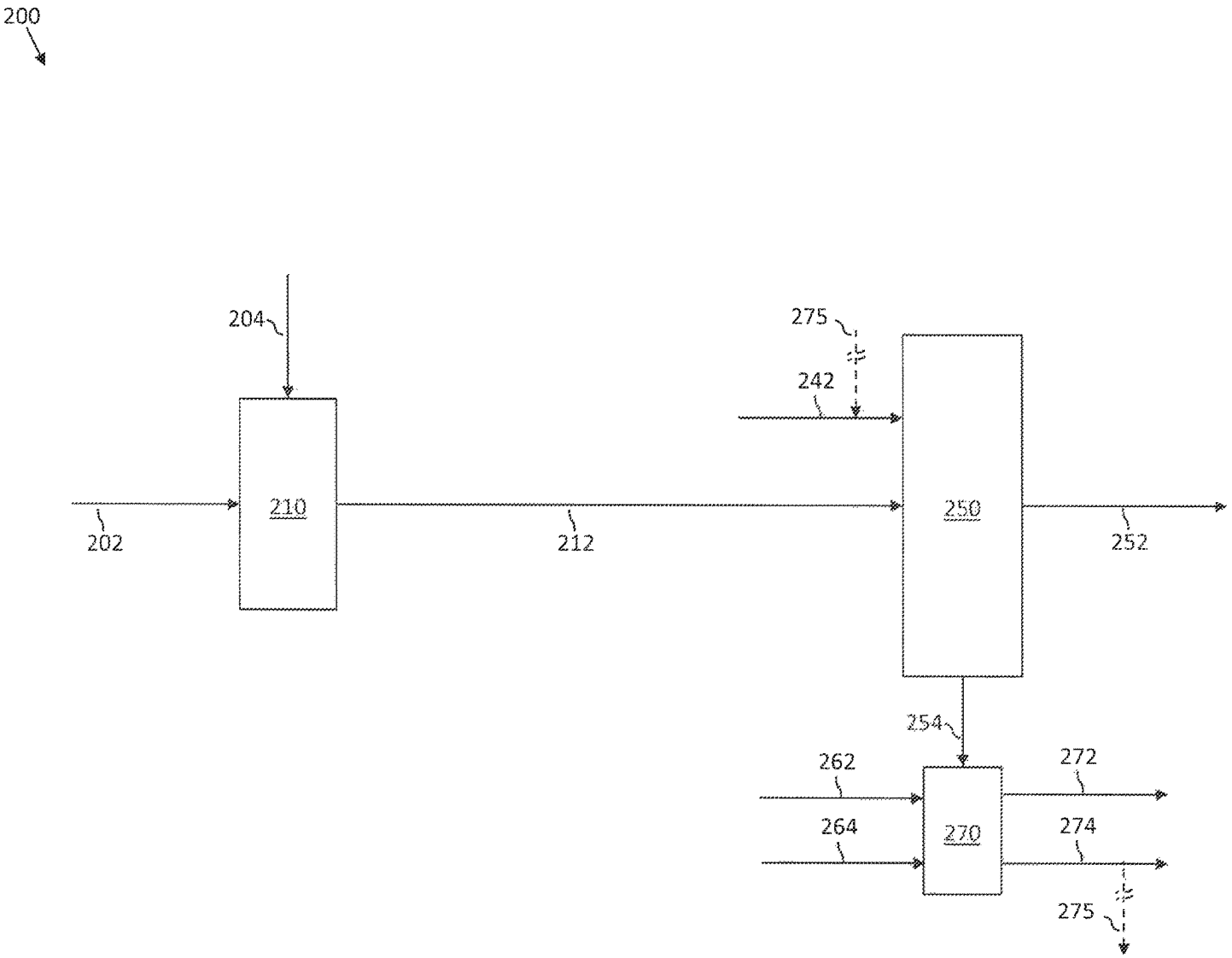
FIG. 2 is a simplified schematic diagram of a first embodiment of the process of the present disclosure.

Referring now to FIG. 2, an embodiment of the process and system (200) of the present disclosure that will be referred to as "Embodiment 1" includes mercaptanization zone (210), a mercaptan oxidation, or MEROX zone (250), and a wet air oxidation zone (270).

A light naphtha feed (202) comprising olefins and a hydrogen sulfide stream (204) are introduced into mercaptanization zone (210) to catalytically convert olefins present in the feed (202) into mercaptans and thereby produce a substantially olefin-free effluent stream (212). The substantially olefin-free effluent stream (212) is introduced with fresh alkali caustic solution (242) into a MEROX reaction zone (250) to sweeten the stream and produce a spent caustic and alkali metal alkane thiolate mixture stream (254) and sweet light naphtha stream (252) that is substantially free of olefins and of mercaptan.

The sweet light naphtha stream (252) is recovered and the spent caustic and alkali metal alkane thiolate mixture stream (254) is introduced with a catalyst stream (262) and air (264) into the wet air oxidation zone (270) to provide the regenerated spent caustic (274) and to convert the alkali metal alkane thiolate compounds to disulfide oils (272), which can be recovered or passed for further downstream processing (not shown). A portion or all of the regenerated spent caustic (274) can optionally be recycled as stream (275) for mixing with fresh alkali caustic solution (242) prior to introduction into MEROX reaction zone (250). In an embodiment, the regenerated caustic and fresh caustic streams can be introduced into a mixing and storage vessel (not shown) from which it is introduced as needed into the MEROX reaction zone (250).

Figure 3:
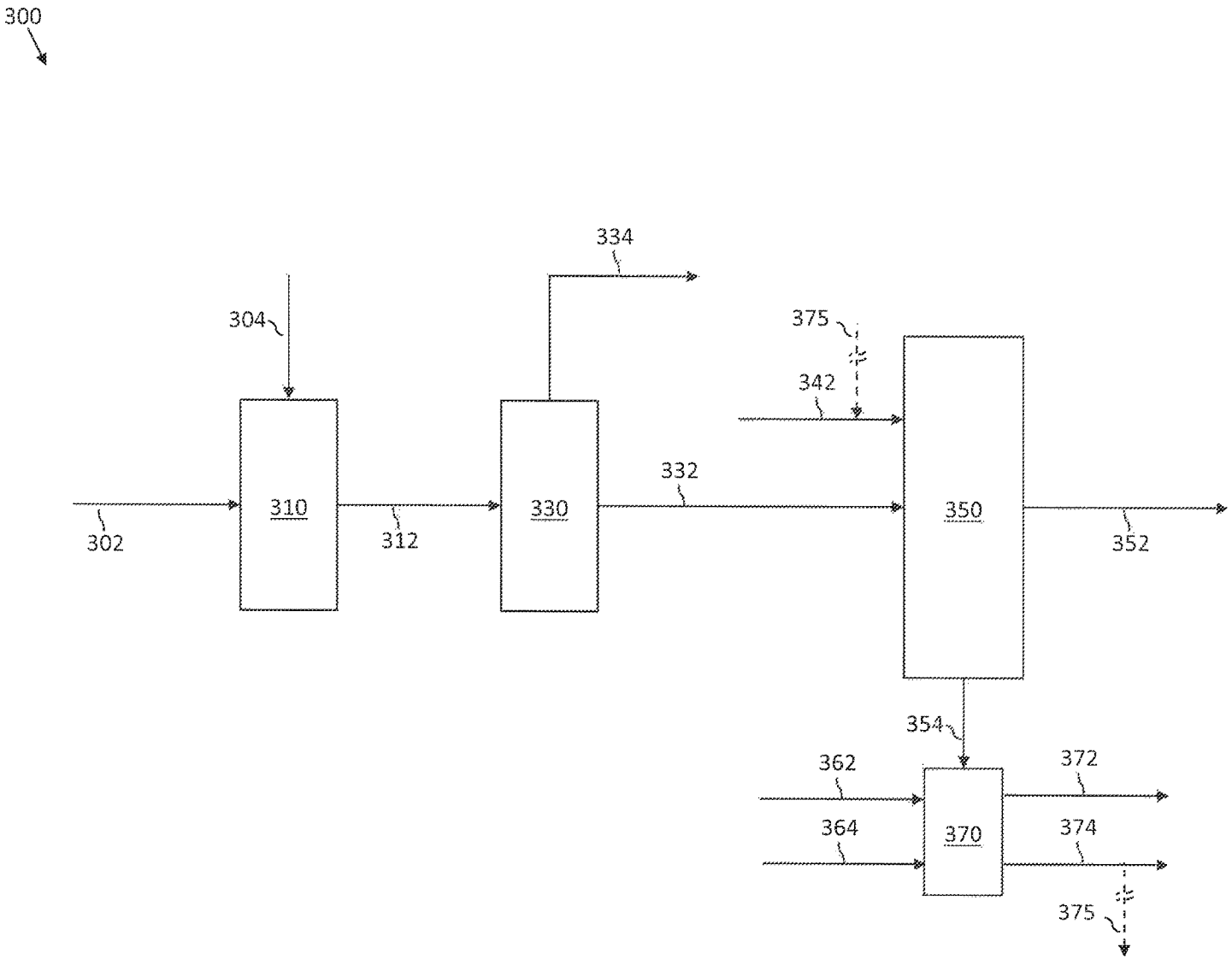
FIG. 3 is a simplified schematic diagram of a second embodiment of the process of the present disclosure.

Referring now to FIG. 3, an embodiment of the process and system (300) of the present disclosure that will be referred to as "Embodiment 2", includes mercaptanization zone (310), a fractionation zone (330) a mercaptan oxidation, or MEROX zone (350), and a wet air oxidation zone (370).

A light naphtha feed (302) comprising olefins and hydrogen sulfide stream (304) are introduced into mercaptanization zone (310) to catalytically convert olefins present in the feed (302) into mercaptans and thereby produce a substantially olefin-free effluent stream (312). The substantially olefin-free effluent stream (312) is introduced into a fractionation zone (330) to separate a light naphtha stream (334) comprising paraffins, naphthenes and aromatics which is substantially olefin free from a mercaptan stream (332) that is also substantially olefin free. The light naphtha stream (334) is recovered.

The mercaptan stream (332) is introduced with an alkali caustic solution (342) into a MEROX zone (350) to sweeten the stream and produce a spent caustic and alkali metal alkane thiolate mixture stream (354) and sweet light naphtha stream (352) that is substantially free of both olefins and mercaptans.

The sweet light naphtha stream (352) is recovered, and can optionally be combined with light naphtha stream (334) (not shown). The spent caustic and alkali metal alkane thiolate mixed stream (354) is introduced with a catalyst stream (362) and air (364) into the wet air oxidation zone (370) to provide the regenerated spent caustic stream (374) and to convert the alkali metal alkane thiolate compounds to disulfide oils (372), which can be recovered or further processed downstream (not shown). A portion or all of the regenerated spent caustic (374) can optionally be recycled as stream (375) for mixing with fresh alkali caustic solution (342) prior to its introduction into MEROX zone (350).

Figure 4:
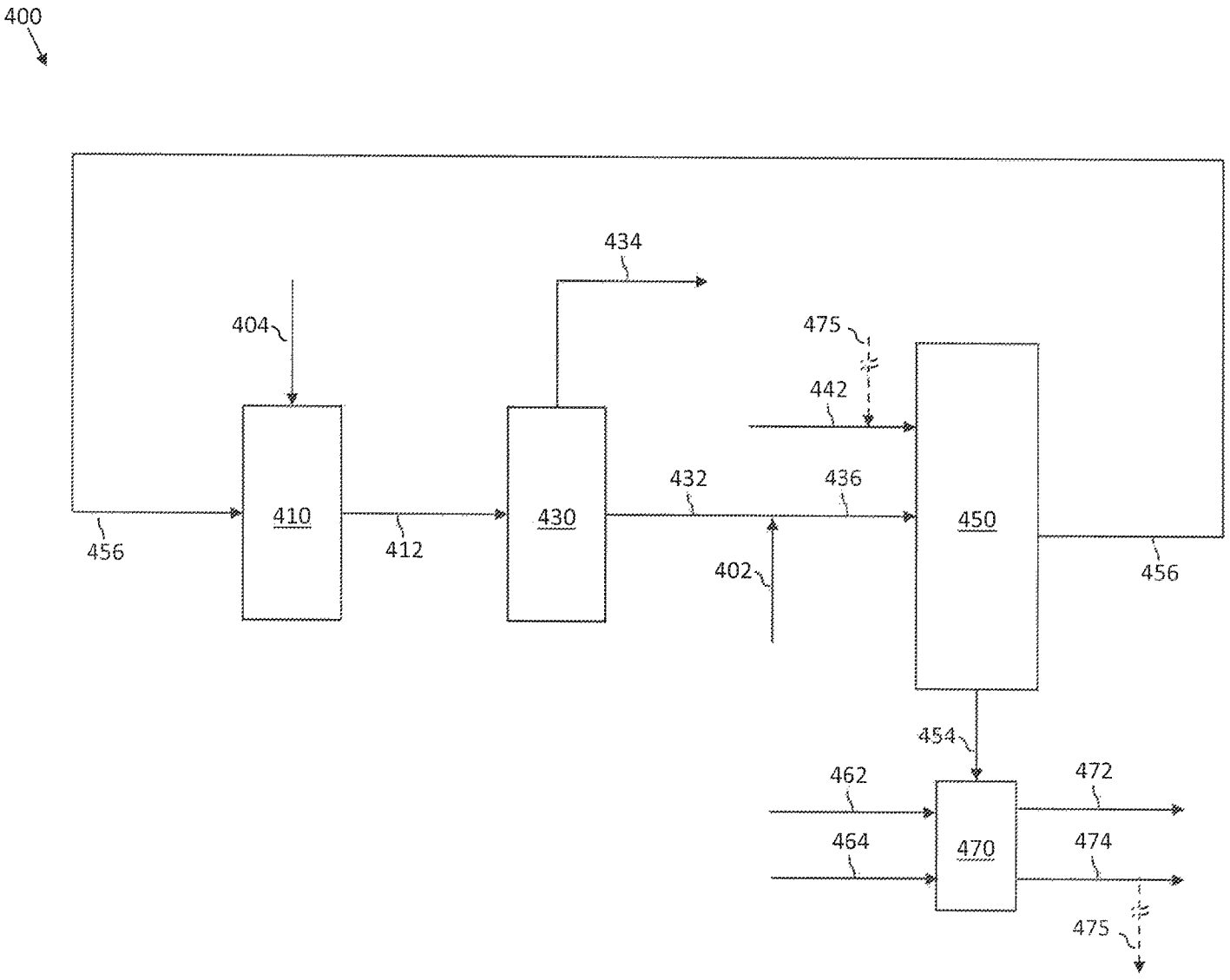
FIG. 4 is a simplified schematic diagram of a third embodiment of the process of the present disclosure.

Referring now to FIG. 4, an embodiment of the process and system (400) of the present disclosure that which will be referred to as "Embodiment 3", includes mercaptanization zone (410), a fractionation zone (430) a mercaptan oxidation, or MEROX reaction zone (450), and a wet air oxidation zone (470).

A light naphtha feed (402) comprising olefins is mixed with internally-generated mercaptan stream (432) to form a mixture (436) that is introduced with an alkali caustic solution (442) into a MEROX reaction zone (450) to sweeten the stream and produce a spent caustic and alkali metal alkane thiolate mixture stream (454) and sweet light naphtha stream (456) that is substantially mercaptan free and comprises olefins.

The spent caustic and alkali metal alkane thiolate mixture stream (454) is introduced with a catalyst stream (462) and air (464) into the wet air oxidation zone (470) to provide the regenerated spent caustic (474) and to convert the alkali metal alkane thiolate compounds to disulfide oils (472), which can be recovered as a product, or further processed downstream (not shown). A portion or all of the regenerated spent caustic (474) can optionally be recycled as stream (475) for mixing with alkali caustic solution (442) prior to introduction with MEROX zone (450).

The sweetened light naphtha stream (456) is introduced and hydrogen sulfide stream (404) are introduced into mercaptanization zone (410) to catalytically convert olefins present in the feed (402) into mercaptans and thereby produce a substantially olefin-free effluent stream (412). The substantially olefin-free effluent stream (412) is introduced into a fractionation zone (430) to separate a light naphtha stream (434) comprising paraffins, naphthenes and aromatics and that is substantially olefin free from the mercaptan stream (432) that is substantially olefin free. The light naphtha stream (434) is recovered. The mercaptan stream (432) is internally recycled and mixed with light naphtha feed (402).

As will be understood by one of skill in the art, the above processes are described in terms of steady-state continuous operating conditions which follow a start-up period that is required for each of the unit operations.

The fractionation zones can include units such as atmospheric columns, distillation columns, flash columns, gas strippers, steam strippers, alone or in combination.

Suitable reactors used in the mercaptanization zone include, but are not limited to fixed bed, ebullated bed, slurry, moving bed and continuous stirred-tank reactors (CSTR).

The mercaptanization unit can operate at temperatures in the range of from 80° C. to 300° C., 150° C. to 300° C., or 200° C. to 300° C.; at pressures in the range of from 10 bars to 50 bars, 10 bars to 30 bars, or 10 bars to 20 bars; at a liquid hourly space volume (LHSV) in the range of from 1 $h^{-1}$ to 100 $h^{-1}$, 2 $h^{-1}$ to 40 $h^{-1}$, or 5 $h^{-1}$ to 30 $h^{-1}$; and at hydrogen sulfide-to-olefin molar ratios in the range of from 1:1 to 100:1, 1:1 to 5:1, or 1:1 to 2:1.

A suitable catalyst for use in the mercaptanization unit is an active phase metal catalyst that is selected from Periodic Table IUPAC Groups 4-11 and is supported by an alumina, silica, silica-alumina, titania, or zeolite support.

In all embodiments, the mercaptanization unit can include gas-liquid separators for separation of the hydrogen sulfide from the liquid effluent stream (not shown). The recovered hydrogen sulfide can optionally be recycled to the mercaptanization unit. The liquid effluent stream is a substantially olefin-free effluent stream that is introduced into either the MEROX zone (Embodiment 1) or the fractionation zone (Embodiments 2 and 3).

Disulfide oils produced can optionally be catalytically cracked to recover substantially pure olefins that can be used as chemical building blocks to make other fuel components or chemicals. These substantially pure olefins are of higher value than the olefins present in the original light naphtha stream, which due to their impurities, cannot be used effectively as a building block for other high value products.

In preferred embodiments, the feedstream to the process can include light naphtha hydrocarbon streams derived from catalytic reforming, steam cracking, fluid catalytic cracking (FCC), delayed coking or flexi-coking, isomerization, visbreaking, transalkylation, cracking in the presence of water and other types of non-conventional hydrocarbon processing, alone or in combination. In some embodiments, the feedstream to the process boils in the range of from about 10° C. to 220° C. A light naphtha stream containing $C_4$ olefins can have an initial boiling point of −10° C. In these embodiments, the feedstream has a boiling point in the range of from about −10° C. and up to 85° C. The feedstream can contain from 0.1 to 50 W %, from 0.1 to 30 W %, or from 0.1 to 10 W % of olefinic constituents. It should also be understood that the presence of paraffins will not adversely affect the processs.

EXAMPLE 1

A light naphtha stream recovered from a delayed coking unit operation was subjected to mercaptanization with hydrogen sulfide in a fixed-bed reactor at a temperature of 200° C. and a pressure of 15 bars. The hydrogen sulfide was generated in situ by the decomposition of dimethyldisulfide (DMDS) with hydrogen over a catalyst bed in the same reactor. The mercaptanized stream was subjected to the MEROX process steps as described above to provide an olefin-free feedstock. Table 3 includes the composition and properties of a typical light naphtha stream. The total sulfur content of the light naphtha stream is 4,000 ppmw of which 2,848 ppmw is mercaptans. The original disulfide content is negligible and 20.2. W % of total sulfur of the light naphtha stream is thiophenic sulfur. The light naphtha stream contains 35.8 V % of olefins and has the very low aromatics content of only 2.1 V %.

TABLE 3

| PROPERTY | Unit | Value |
|---|---|---|
| Boiling Point Range | ° C. | 32-115 |
| Yield (total coker Naphtha basis) | V % | 54.0 |
| Gravity | ° API | 72.2 |
| Density @60° F./15.6° C. | Kg/Lt | 0.695 |
| Sulfur | ppmw | 4,000 |
| Basic Nitrogen | ppmw | 1.0 |
| Nitrogen | ppmw | 69 |
| n-paraffins | V % | 25.4 |
| i-paraffins | V % | 21.5 |
| Olefins | V % | 35.8 |
| Naphthenes | V % | 10.7 |
| Aromatics | V % | 2.1 |
| Unknowns | V % | 4.4 |
| Reid Vapor Pressure | psi | 2.9 |
| Maleic Anhydride Value | | 19.7 |
| Diene Value | | 0.020 |
| Sulfur Distribution (of total sulfur) | | |
| Mercaptans | W % | 71.2 |
| Dialkyl Sulfides | W % | 8.4 |
| Disulfides | W % | 0.2 |
| Thiophenes | W % | 20.2 |

The light naphtha stream was processed in accordance with Embodiment 1 as schematically illustrated in FIG. 2. The material balance for the process is shown in Table 4.

When 1000 kg of light naphtha is processed, 639 kg of olefin-free sweet light naphtha and 511 kg of disulfide oil are recovered. The olefin-free hydrocarbon can be sent to a steam cracking unit to produce ethylene. The disulfide oils produced can be catalytically cracked to produce high purity light olefins.

TABLE 4

| Stream # | Description | Mass Flow, Kg/h |
|---|---|---|
| 202 | light naphtha | 1000.0 |
| 204 | hydrogen sulfide | 158.1 |
| 212 | olefin-free effluent | 1158.1 |
| 242 | alkali caustic solution (NaOH) | 4757.5 |
| 252 | sweet light naphtha | 639.2 |
| 254 | spent causticand alkali metal alkane thiolate | 5273.6 |
| 262 | catalyst | Negligible |
| 264 | air | Negligible |
| 272 | disulfide oil | 511.4 |

The processes of the present disclosure have been described above and in the attached figures; process modifications and variations will be apparent to those of ordinary skill in the art from this description and the scope of protection is to be determined by the claims that follow.

The invention claimed is:

1. A process for treating an olefin-containing light naphtha feedstock, the process comprising:

a. introducing the light naphtha feedstock containing olefins, an internally-produced mercaptan stream and an alkali caustic solution into a mercaptan oxidation treatment zone to produce a spent caustic and alkali metal alkane thiolate mixture stream and sweet light naphtha product stream that is substantially mercaptan free and comprises olefins;

b. passing the spent caustic and alkali metal alkane thiolate mixture stream, catalyst, and air into a wet air oxidation zone to produce a regenerated spent caustic stream and a disulfide oils product stream;

c. recovering the disulfide oils product stream;

d. passing the sweet light naphtha product stream and hydrogen sulfide into a mercaptanization zone containing a catalyst and catalytically reacting hydrogen sulfide with the olefins to produce a treated effluent stream that is substantially free of olefins;

e. passing the treated effluent stream to a fractionation zone and recovering a sweet light naphtha product stream and the internally-produced mercaptan stream of step (a).

2. The process as in claim 1, wherein a portion of the regenerated spent caustic stream is recycled and mixed to constitute the alkali caustic solution for introduction into the mercaptan oxidation treatment unit.

3. The process as in claim 1, wherein the olefin-containing light naphtha feedstock is selected from the group consisting of light naphtha hydrocarbon streams derived from catalytic reforming, steam cracking, fluid catalytic cracking (FCC), delayed coking or flexi-coking, isomerization, visbreaking, transalkylation, and combinations thereof.

4. The process as in claim 1, wherein the olefin-containing light naphtha feedstock has a boiling point in the range of from −10° C. to 80° C.

5. The process as in claim 1, wherein the olefin-containing light naphtha feedstock comprises $C_5$-$C_6$ olefins.

6. The process as in claim 1, wherein the mercaptanization zone contains a catalyst that is an active phase metal catalyst selected from Periodic Table Groups 4-11 supported by an alumina, silica, silica-alumina, titania, or zeolite support.

7. The process as in claim 1, wherein the mercaptanization zone operates at a temperature in the range of from 80° C. to 300° C., at a pressure in the range of from 10 bars to 50 bars, at a liquid hourly space volume (LHSV) in the range of from 1 $h^{-1}$ to 100 $h^{-1}$, and at hydrogen sulfide-to-olefin molar ratios in the range of from 1:1 to 100:1.

* * * * *